United States Patent [19]

Huang

[11] 3,991,491

[45] Nov. 16, 1976

[54] MASTER SLIPPER

[76] Inventor: Ming Der Huang, 2nd Fl. No. 9-1, Lane 100, Bao Jinn Rd., Chung-Ho, Taipei, Taiwan, China /Taiwan

[22] Filed: Oct. 23, 1975

[21] Appl. No.: 625,006

[52] U.S. Cl. ..... 36/11.5
[51] Int. Cl.[2] ..... A43B 3/12
[58] Field of Search ..... 36/11.5, 2.5 R

[56] References Cited

UNITED STATES PATENTS

| | | | |
|---|---|---|---|
| 1,980,621 | 11/1934 | Innis | 36/11.5 |
| 2,469,708 | 5/1949 | Alexander | 36/11.5 |
| 3,874,100 | 4/1975 | Schwitters | 36/11.5 |

*Primary Examiner*—Patrick D. Lawson
*Attorney, Agent, or Firm*—Cushman, Darby & Cushman

[57] ABSTRACT

A "master" slipper being capable of being freely worn in optional direction, characterized in that, said slipper is made into an universal form, such as: oval or rectangular type and is fitted in its central position a strap so that the front portion and the heel portion thereof can not be distinguished. This slipper is provided for easy and convenient wearing use without regarding the direction to wear it.

1 Claim, 6 Drawing Figures

MASTER SLIPPER

BACKGROUND OF THE INVENTION

The current slippers are designed and produced in a large quantity to provide for human daily use. However, the conventional style and structure of slipper has been designed and divided into right and left slipper from a pair of slippers. Whenever wearing the current slipper, one should be very careful to wear the correct side slipper to prevent any confused wearing, such as: right foot wearing into left side slipper and vice versa. Furthermore, as confined by the slipper structure, any missing of either slipper of the pair will affect the usage of other slipper and thereby cause loss.

The other defect of the conventional slippers is found wherever and whenever coming in or out a room, house, bathroom, toilet, and bedroom, the direction of slipper as entrance will be opposited to that as going out. This will then cause inconvenience.

The present inventor has found these defects and made an effect to improve and disclose this inventive slipper.

SUMMARY OF THE INVENTION

The present invention relates to a "master" slipper which can be worn from optional direction. With this slipper, the style is universal and formed as oval or rectangular type; Both end of the slipper are shaped in the same form and structure and a strap is provided in the central sole. Hence, there is no difference of front portion and heel portion of a shoes from the conventional one. Either right or left side of the pair of slippers is made same in structure and appearance. The object of the present invention is to make people easier in wearing the shoes and to prevent any confused wearing the shoes.

DESCRIPTION OF THE PREFERRED EMBODIMENT

The present master slipper is composed of: sole 1 strap 2, guide groove 3 and axis 4. Either right or left side slipper of the pair of slippers is made into a universal shape. Both end of the slipper are designed to be the same, e.g. rectangular type or oval type.

Figure 1:
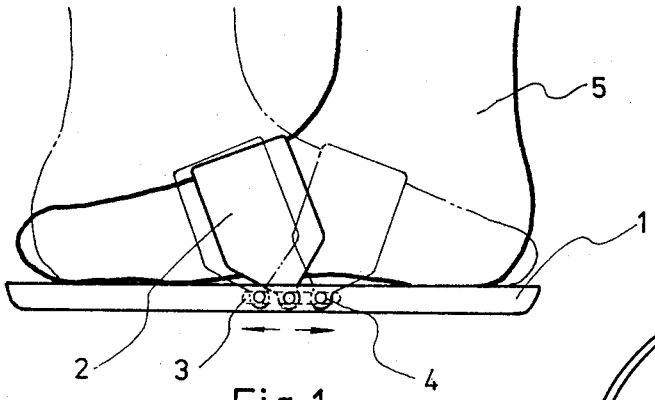
FIG. 1 is a front view of the preferred embodiment in accordance with the present invention.
Figure 4:
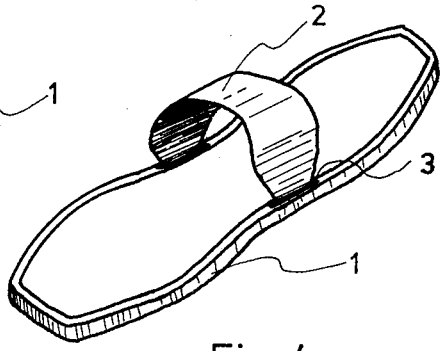
FIG. 4 is an isometric drawing of the present embodiment.
Figure 2:
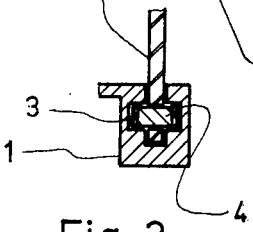
FIG. 2 is a partial cross sectional drawing (side view) of strap assembly of the slipper.
Figure 3:
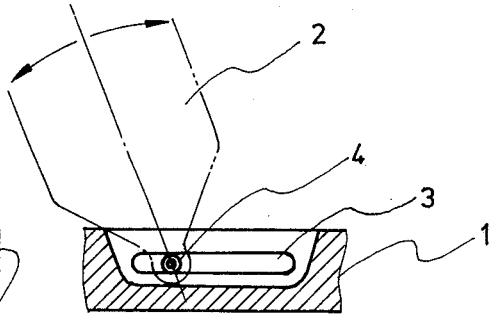
FIG. 3 is a front view of FIG. 2.

As shown in FIGS. 1 & 4, a strap 2 is fitted in the central position on sole 1. The slipper now can not be distinguished between the front portion and the heel portion. Said strap 2 can be slipped to move its position or changed its tilting angle (Slope) to meet the wearing requirement by means as shown in FIGS. 1, 2 and 3. Namely, at both sides of the shank (waist), two same grooves 3 are respectively opened along each side of sole waist. An axis 4 is provided in each end of said strap 2 so as to pivotally mount said strap 2 into groove 3 on each side of sole 1.

Whenever inserting foot into strap of the present slipper, said strap 2 will correspondingly tilt, and comfort the wearing of foot 5 by the actions of said axis 4 and groove 3. (Please refer to FIG. 5)

Figure 5:
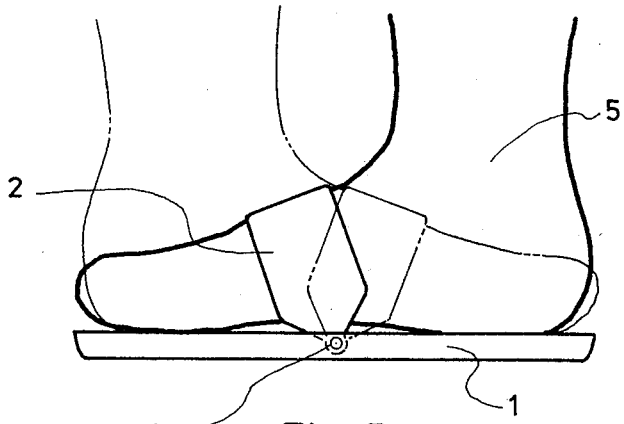
FIG. 5 is an example of the present invention: Movable strap type.
Figure 6:
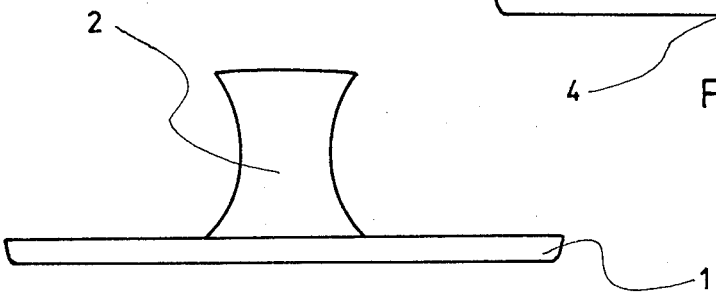
FIG. 6 is an example of the present invention: Fixed strap type.

Moreover, strap 2 can be fixed in a steady position other than the above-mentioned movable position. As shown in FIG. 6, said strap 2 is fixed in the central position on sole 1. Besides, said strap 2 can be moved forward or backward by the axis 4 in a specific position to suit the wearing conditions. (FIG. 5)

I claim:

1. A foot slipper comprising a sole having identical end portions and a center portion with a groove on both sides thereof and a strap having its ends pivotably mounted in said grooves for movement along the length of said grooves and forming a loop so that the slipper can be worn either with the heel at one end portion and the toes at the other end portion or vice versa.

* * * * *